United States Patent [19]

Archer et al.

[11] Patent Number: 4,495,504

[45] Date of Patent: Jan. 22, 1985

[54] RADIO FREQUENCY ANTENNA HAVING A REFLECTOR WITH AN EDGE IN A PATTERN NULL REGION TO REDUCE EDGE SCATTERING

[75] Inventors: Donald H. Archer; Michael A. Gilbert; Robert H. Loomis; Michael J. Maybell, all of Santa Barbara, Calif.

[73] Assignee: Raytheon Company, Lexington, Mass.

[21] Appl. No.: 471,552

[22] Filed: Mar. 2, 1983

[51] Int. Cl.[3] ..... H01Q 19/17

[52] U.S. Cl. ..... 343/779; 343/781 P; 343/914

[58] Field of Search ..... 343/779, 781 R, 781 P, 343/781 CA, 837, 838, 914, 368, 371

[56] References Cited

U.S. PATENT DOCUMENTS 2,925,595 2/1960 Thourel ..... 343/781

*Primary Examiner*—Eli Lieberman

*Attorney, Agent, or Firm*—Richard M. Sharkansky; Joseph D. Pannone

[57] ABSTRACT

A reflector type radio frequency antenna having: a feed for producing a difference radiation pattern with a cone-shaped null region; and, a reflector having a surface disposed to reflect a portion of the energy in the difference radiation pattern and having the edge disposed in the cone-shaped null region. With such arrangement, since the edge of the reflector is disposed in the null region of the difference radiation pattern such edge is not radiated with energy which could otherwise illuminate such edge, scatter, and thereby generate unwanted side lobes in the free space antenna pattern.

4 Claims, 7 Drawing Figures

RADIO FREQUENCY ANTENNA HAVING A REFLECTOR WITH AN EDGE IN A PATTERN NULL REGION TO REDUCE EDGE SCATTERING

BACKGROUND OF THE INVENTION

This invention relates generally to radio frequency antennas and more particularly to reflector type radio frequency antennas.

As is known in the art in many applications, it is sometimes necessary to provide compact radio frequency antennas having extremely low side lobe characteristics. One type of compact antenna is a reflector antenna wherein energy coupled to the feed of the antenna is reflected by a reflective surface prior to radiation into free space. One well known method for obtaining low side lobes from a reflector antenna is to shape the pattern of the fed energy so that the amplitude of such fed energy is greatly reduced at the edge of the reflector. That is, the fed energy is reduced at the edge of the reflector so that the edge will not scatter the energy incident thereon and thereby generate unwanted side lobes in the free-space radiation pattern.

Various techniques have been used to taper the energy of the fed energy and thereby reduce the amount of the fed energy striking the edge of the reflector; for example, scalar reflector fed antennas, such as: corrugated, dielectric or multi-mode feed type antennas; and multi-element array fed type antennas. While such antennas do provide a degree of illumination taper, they have a relative large height profile and are therefore not compact enough for many applications, such as airborne applications.

SUMMARY OF THE INVENTION

In accordance with the present invention, a radio frequency antenna is provided having a feed means for producing an antenna pattern having a pair of radiation lobes with a null region therebetween; and, a reflector having a surface disposed to intercept a portion of the antenna pattern, and an edge disposed in the null region.

In a preferred embodiment of the invention, the feed means includes means for producing a difference radiation pattern and the edge of the reflector is disposed in the null of the difference radiation pattern. The feed means further includes means for forming the difference pattern with a cone-shaped null region and wherein the edge of the reflector is disposed in the cone-shaped null region.

In accordance with the invention the feed means includes means for coupling a pair of radio frequency signals having one hundred and eighty degrees of phase shift therebetween to a pair of radiating elements with the electrical length from a source of such pair of signals to one of the radiating elements differing from the electrical length from such source to the other one of such radiating elements an amount $\Delta L$ to generate the null region of the difference radiation pattern on the surface of a right circular cone having solid angle at the vertex thereof equal to $2\pi(1-\sin\theta)$ where $\theta=\sin^{-1}(\Delta L/a)$ and "a" is the center to center separation between the radiating elements.

With such arrangement, since the edge of the reflector is disposed in the null region of the difference radiation pattern such edge is not radiated with energy which would otherwise illuminate such edge, scatter, and thereby generate unwanted side lobes in the free space antenna pattern. Further, the reflector intercepts the portion of the energy disposed on one side of the null region and, such energy, after reflection of such portion of the energy by the reflector is directed in substantially the same direction as, and combines with, the energy disposed on the other side of the null region to form a composite beam which is radiated into free space.

BRIEF DESCRIPTION OF THE DRAWINGS

The foregoing features of the invention as well as the invention itself, may be more fully understood from the following detailed description read together with the accompanying drawings, in which.

DESCRIPTION OF THE PREFERRED EMBODIMENT

Figure 1:
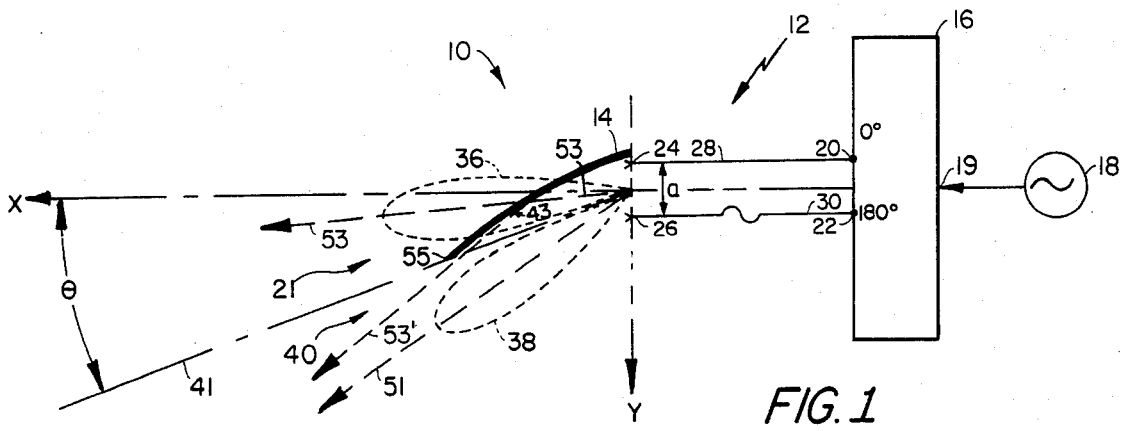
FIG. 1 is a diagrammatical drawing of an antenna according to the invention showing a difference radiation pattern generated by such antenna in a two-dimensional X-Y plane.

Referring now to FIG. 1, a radio frequency antenna 10 is shown to include a difference radiation pattern generating feed 12 and a reflector 14. The difference radiation pattern generating feed 12 includes a hybrid junction 16 having an input 19 coupled to a source 18 of radio frequency energy, and a pair of outputs 20, 22; the signals produced at the pair of outputs 20, 22 of the hybrid coupler 16 differing in phase by 180 degrees. A pair of radiating elements 24, 26 is coupled to the pair of outputs 20, 22 through a pair of electrical transmission lines 28, 30, respectively as indicated. The electrical length of transmission line 30 is longer than the electrical length of transmission line 28 an amount ($a \sin\theta$) over the operating bandwidth of the antenna 10, where "a" is the center to center separation of the radiating elements 24, 26. It follows then that if the radiating elements 24, 26 are disposed along a Y-axis and the centers of radiating elements 24, 26 are separated the distance "a", then, in the X-Y plane shown in FIG. 1, a difference radiation pattern 21 will be formed, such pattern 21 having a pair of radiation lobes 36, 38 disposed on opposite ends of the null region 40 formed between such lobes 36, 38. It is noted that on the X-Y plane shown in FIG. 1 the null region 40 is along dotted line 41, such line 41 being the center line of the null region 40. The center line 41 is thus displaced from the X-axis by the angle $\theta$, as shown. It is noted that reflector 14 has a surface 43 disposed to intercept and reflect a portion of the energy on the radiation pattern 21, in particular the energy in lobe 36. It is further noted that the energy in lobe 38 radiates directly into free space. Further, the reflector 14 and feed 12 are arranged so that the portion of the energy reflected by surface 43 of reflector 14 is directed in substantially the same direction as, and combines with, the energy in lobe 38 to provide, in free space, a composite beam of radiation. That is, if the direction of lobe 38 is indicated by dotted line 51 and the initial direction of lobe 36 (i.e. prior to reflection) is along dotted line 53, the surface 43 of reflector 14 is disposed so that the direction of the lobe 36 after reflection is, as indicated by dotted line 53', in substantially the same direction 51 as of lobe 38, i.e. the direction of the composite beam. It is also noted that the edge 55 of reflector 14 is disposed in the null region 40 of the difference radiation pattern 21 and in particular edge 55 is disposed on the null region center line 41 hence such edge 55 is not radiated with the energy in the difference radiation pattern 21.

Figure 2:
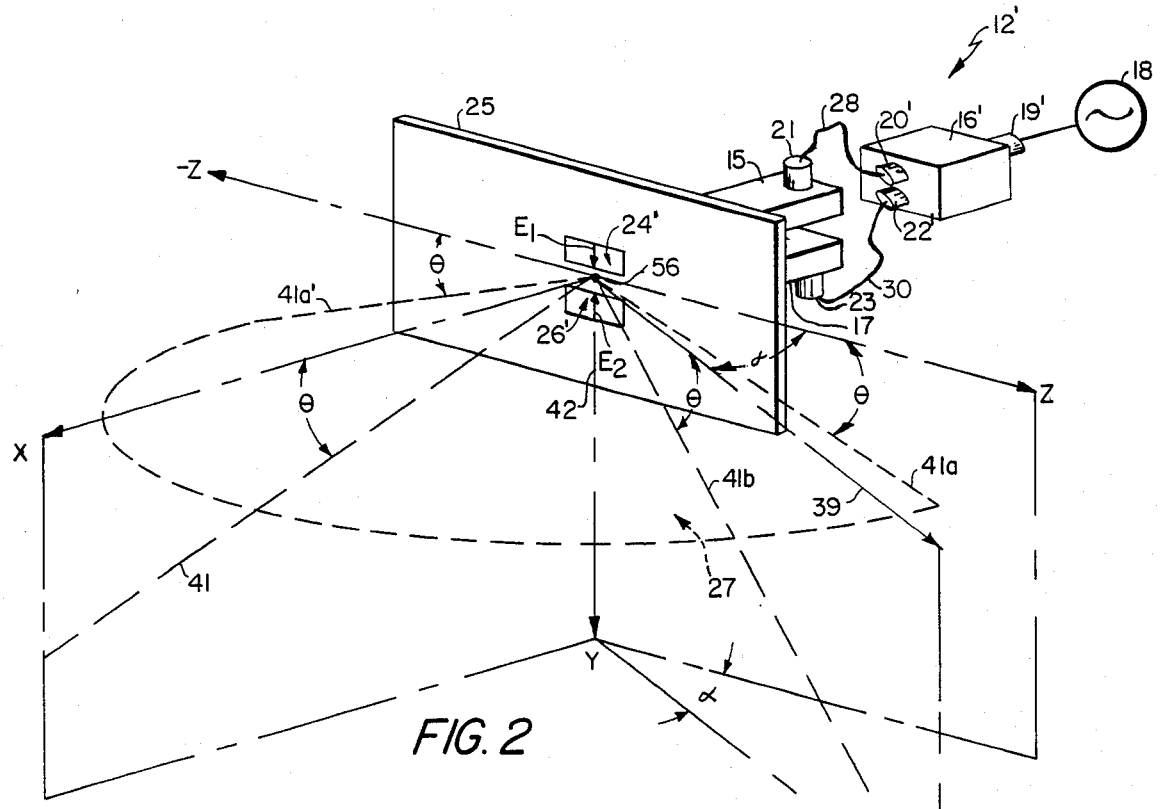
FIG. 2 is an isometric drawing showing the feed portion of an antenna according to the invention and also showing the difference radiation pattern cone-shaped null locus generated by such antenna in three dimensions.

Referring now to FIG. 2, a difference radiation pattern feed 12' is shown. Such feed 12' generates a difference radiation pattern with the null of the difference radiation pattern generated being shown in phantom in three dimensional space. Here feed 12' includes a pair of equal length rectangular waveguide sections 15, 17. Apertures of such waveguide sections 15, 17 provide a pair of radiating elements 24', 26' equivalent to the radiating elements 24, 26 of the feed 12 shown in FIG. 1. A pair of conventional coaxial transmission lines to waveguide transition probes 21, 23 are coupled to the ends of the waveguide sections 15, 17 in a conventional manner as shown so that in response to radio frequency energy fed to such probes 21, 23 by coaxial transmission lines 28, 30 electromagnetic energy passes through the waveguide sections 15, 17 in the TE 10 mode. The long dimensions of the cross sections of the rectangular waveguide sections 15, 17 are along the Z axis and the narrow dimensions are along the Y axis as shown. It is noted that the probes 21, 23 are disposed in opposite directions along the Y axis so that the electric field vector of the radio frequency energy passing from probe 21 to the aperture of waveguide section 15 (which provides radiating element 24') is pointed along the Y axis, as represented by arrow $E_1$ while the electric field vector of the radio frequency energy passing from probe 23 to the aperture of waveguide section 17 (which provides radiating element 26') is pointed along the (−Y) axis, as represented by arrow $E_2$. It is noted that the apertures of waveguide sections 15, 17 terminate in apertures of a planar conductive plate 25 having its surface disposed in the Y-Z plane. Completing the feed 12', an equal power divider 16' is provided, such power divider having an input port 19' coupled to a source 18 of radio frequency energy and a pair of in-phase output ports 20', 22' coupled to probes 21, 23, respectively through coaxial transmission line 28, 30, respectively, as shown. It is noted that, as in FIG. 1, the electrical length of coaxial transmission line 30 is longer than the electrical length of coaxial transmission line 28 an amount (a sin $\theta$) over the operating bandwidth of the feed 12', where "a" is the center to center separation of the radiating elements 24', 26' along the Y axis. As noted above, the signals at ports 20', 22' are equal in power and equal in-phase as distinguished from the signals at outport ports 20, 22 of the hybrid coupler 16 in FIG. 1 where the signals at ports 20, 22 while equal in power have a 180 degree relative phase shift therebetween. With the feed 12' shown in FIG. 2, the 180 degree relative phase shift provided by the hybrid coupler 16 in FIG. 1 is, in effect, provided for the feed 12' in FIG. 2 by orienting the probes 21, 23 so that they launch the energy into waveguides 15, 17 with the electric fields in such energy oriented, in space, in opposite directions, i.e. spatially 180 degrees relative to each other as indicated by arrows $E_1$, $E_2$. The feed 12' thus provides the same equivalent difference radiation pattern provided by the feed 12 in FIG. 1. It is noted here that in three dimensional space the null region 40 (FIG. 1) of the difference radiation pattern (more particularly the center line 41 of the null region 40) is disposed on the surface of a right circular cone 27 shown in phantom in FIG. 2. It is noted that only the half of the right circular cone 27 disposed in the forward hemisphere of the feed 12' is shown. Further the angle at the vertex 56 of the cone (which vertex 56 is on the Y axis and is between radiating elements 24, 26, as shown) has a solid angle $2\pi(1-\sin\theta)$ steradians if the cone were a complete circular cone; here, however, only one half of the cone is shown in phantom; thus shown in phantom is a right semi-circular cone having a solid angle $\pi$ (1- sin $\theta$) at its vertex. Still further, the axis 42 of the cone is disposed along the Y-axis. Thus, it is noted that the null 41 is at angle $\theta$ with respect to the X axis in the X-Y plane. Further, the nulls **41*a*, 41*a'* which are disposed in the Y-Z plane are at the same angle $\theta$ from the Z axis in the Y-Z plane. It follows then that in the general case the null 41*b* is at the angle $\theta$ from an axis 39 in the X-Z plane, where the axis 39 is rotated an angle $\alpha$ about the Y axis. That is, the locus of points on the nulls of the radiation pattern is the surface of right circular cone 27**.

Figure 3:
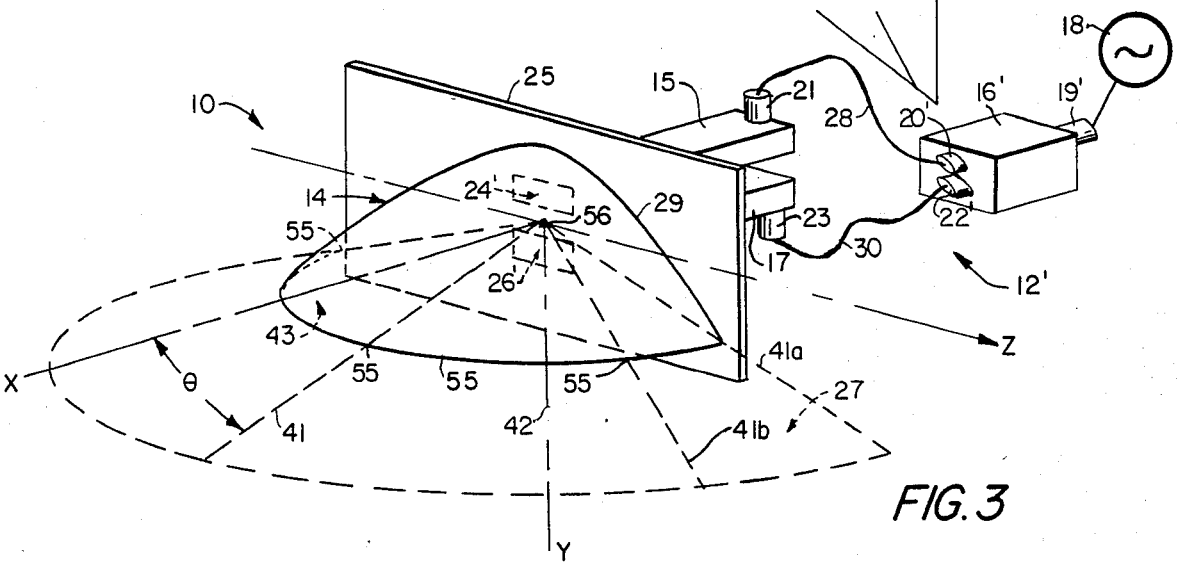
FIG. 3 is an isometric drawing showing an antenna according to the invention and showing, in three dimensions, the relationship between the null of the difference radiation pattern generated by the feed portion shown in FIG. 2 and a reflector of such antenna.
Figure 4:
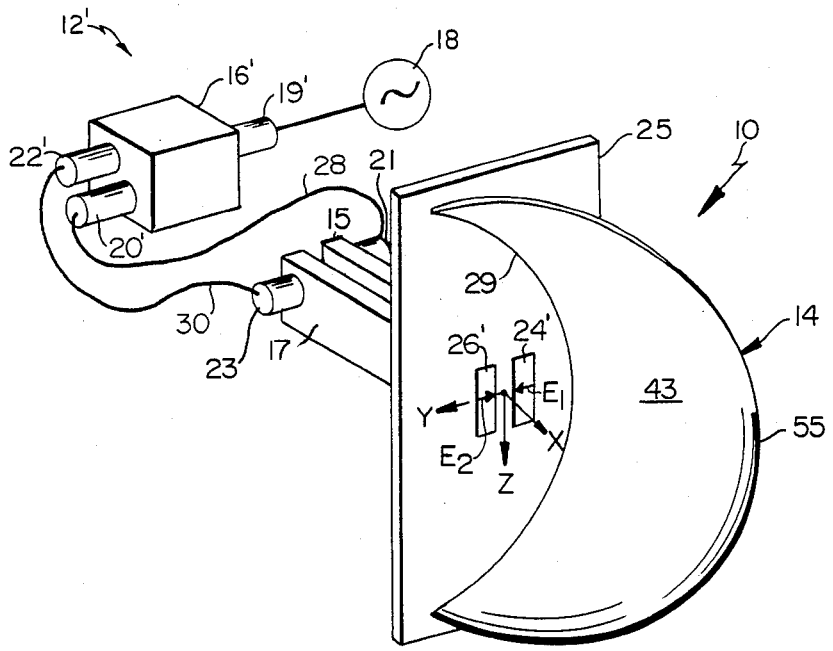
FIG. 4 is an isometric drawing of the antenna of FIG. 3 from a different perspective from that shown in FIG. 3.

Referring to FIGS. 3 and 4, it is noted that in FIG. 3 the reflector 14 has been introduced into the cone-shaped null of the difference radiation pattern generated by feed 12' as shown in FIG. 2. The reflector 14 is attached to plate 25 along an edge 29. The edge 55 of reflector 14 which projects into the forward hemisphere of the antenna 10 is disposed on the surface of the cone-shaped null 27 (i.e. the edge 55 is disposed in the cone-shaped null region 40 in FIG. 1; that is the edge 55 is disposed on the surface of the cone formed by the locus of points on nulls **41, 41*a*, 41*a'*, 41*b* etc. of the difference radiation pattern) and therefore the edge 55 of the reflector 14, being disposed on the surface of the cone-shaped null, is not illuminated by the energy in the generated difference radiation pattern. With regard to the shape of the reflector 14, it is noted that such shape may be a portion of a cone or a parabola of revolution, or any arbitrary shape depending on the specific desired antenna pattern; in any event, however, by disposing the edge 55 of the reflector 14 on the surface of the coneshaped null of the radiation pattern produced by the feeds 12, 12', since the surface of the cone is disposed on the center line 41 of the cone-shaped null region of the difference radiation pattern, such edge 55 of the reflector 14 is not radiated with the energy in the antenna pattern whereas if such edge 55 were not in the null region it would be illuminated with energy and such edge illumination would result in the generation of unwanted side lobes in the free space antenna pattern. As noted above while one portion of the energy in the difference pattern i.e. the energy in the lobe 38 (FIG. 1) of the difference radiation pattern disposed on one side of the null region 40 radiates directly into free space, the energy in the other portion of the difference pattern i.e. the energy in the lobe 36 (FIG. 1) on the other side of the null region 40, is intercepted by the reflector 14 and, after reflection by such reflector 14, radiates into free space. The feeds 12, 12' and reflector 14 are selected so that the portion of the energy (i.e. lobe 36 reflected by surface 43 of reflector 14) is directed in substantially the same direction as, and combines with the energy (i.e. lobe 38) radiated directly into free space to provide a composite beam pointing in substantially the same direction 51 (FIG. 1**).

Figure 5:
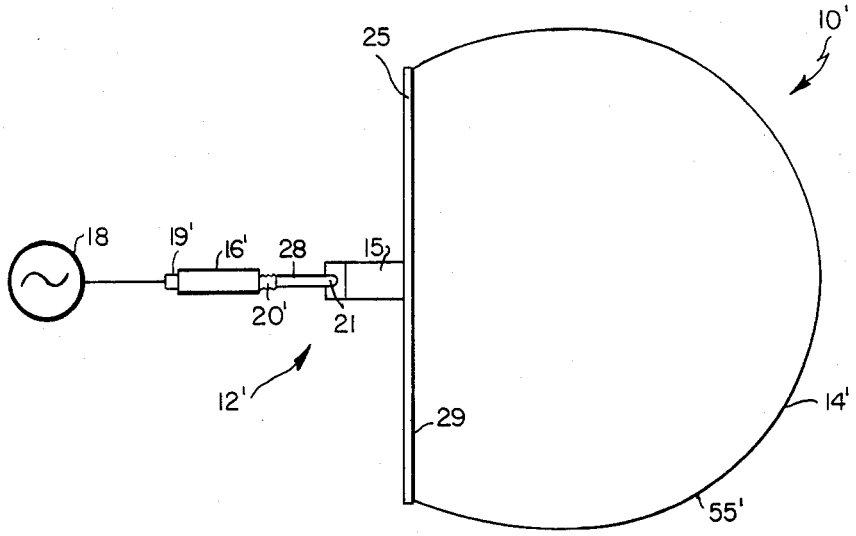
FIGS. 5 and 6 are top and side elevation diagrammatical views of an antenna according to an alternative embodiment of the invention.
Figure 6:
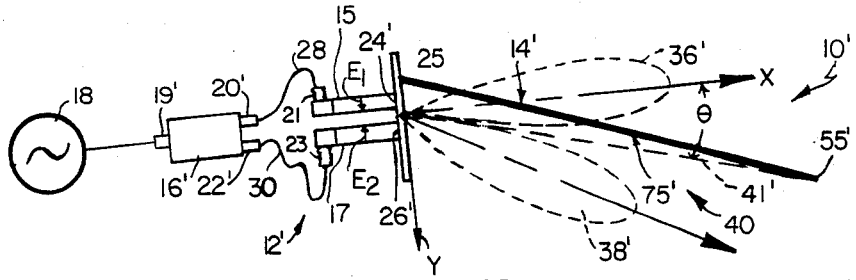
Figure 7:
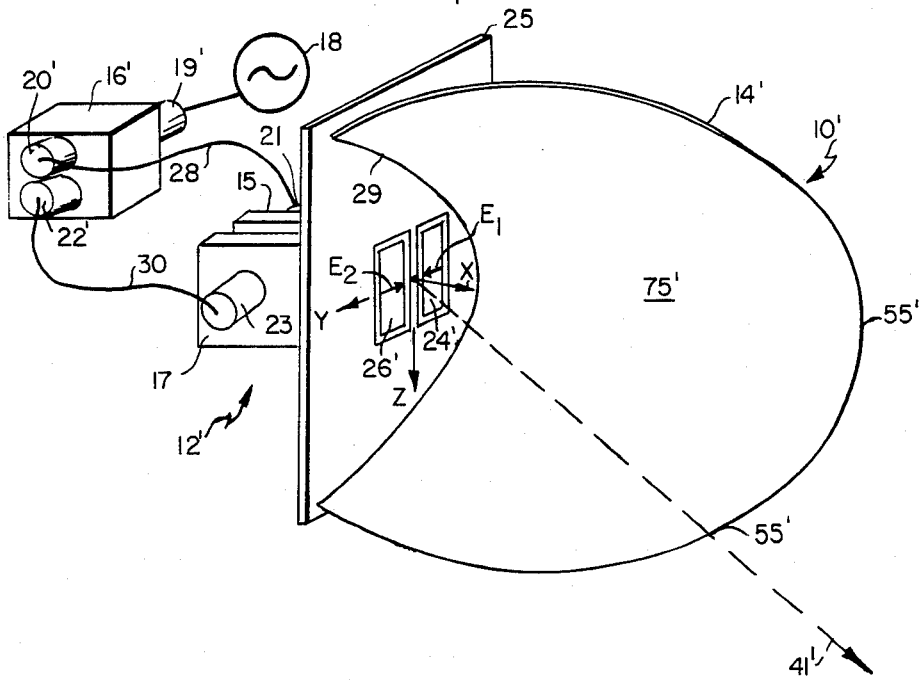
FIG. 7 is a perspective view of the antenna shown in FIGS. 5 and 6.

Referring now to FIGS. 5, 6 and 7 an antenna 10' is shown having a cone-shaped reflector 14' and a difference radiation pattern feed 12' fed from a source 18 of radio frequency energy. It is noted that the axis of the coneshaped null 41' in the difference radiation pattern (i.e. lobes 36', 38') produced by feed 12' and the axis of the cone-shaped reflector 14' are here not coincident to reduce the size of the reflector 14'. It is further noted that the solid angle at the apices of the reflector 14' and coneshaped null 41' are different from each other; the solid angle at the apex of the cone-shaped reflector 14' being less than the solid angle at the apex of the coneshaped null so that the edge 55' of the cone-shaped reflector 14' is disposed on the surface of the coneshaped null 41' in the forward hemisphere of the antenna 10'. The feed 12' includes the power divider 16' having input port 19' fed by source 18 and having output ports with zero degrees relative phase shift therebetween coupled to a pair of radiating elements 24', 26', here apertures of a pair of equal length waveguide sections 15, 17, through coaxial transmission lines 28, 30; the electrical length of coaxial transmission line 30 being longer than the electrical length of the transmission line 28 an amount (a sin $\theta$) where "a" is the center to center separation between the apertures of radiating elements 24', 26' of waveguide sections 15, 17. Conventional coaxial transmission lines to waveguide probes 21, 23 are spatially oriented in opposite directions as shown to provide an additional 180 degrees relative phase shift between signals of elements 24', 26' as described above in connection with FIGS. 2 and 3. The apertures of elements 24', 26' of the waveguide sections 15, 17 are disposed in apertures of mounting plate 25, as shown. Thus, a difference antenna pattern is formed i.e. a radiation pattern with a cone-shaped null region; the surface of the cone being at an angle $\theta$ from the X axis (more generally from the X-Z plane). The rear edge 29 of the reflector 14' is attached to the mounting plate 25, as shown. The coaxial transmission lines 28, 30 are connected to the waveguide sections 15, 17 using conventional probe couplers 21, 23, as shown to launch in such waveguides electromagnetic waves in the TE 10 mode having their electric field vectors oppositely oriented as indicated by arrows $E_1$, $E_2$. It is again noted that the protruding edge 55' of the reflector 14', i.e. the edge 55' disposed in the forward radiating hemisphere of the antenna 10', is disposed on the surface of the cone-shaped null region, i.e. on the surface of the cone-shaped surface of revolution formed by the center line 41' of the null region 40. Further, the reflector 14' has a surface 75' disposed to reflect a portion, i.e. one of the lobes (i.e. lobe 36') of the difference pattern so that after reflection it directs such energy in substantially the same direction as the energy in the other one of the lobes (i.e. lobe 38') which radiates directly into free space. Thus, the reflected energy and the directly radiated energy combine in free space to form a composite beam as described in FIG. 1.

Having described preferred embodiments of the invention, other embodiments incorporating these concepts may be used. It is felt, therefore, that this invention should not be restricted to the disclosed embodiments, but rather should be limited only by the spirit and scope of the appended claims.

What is claimed is:

1. A radio frequency antenna, comprising:

(a) a feed for producing an antenna pattern having a pair of radiating lobes with a null region between such radiating lobes; and (b) a reflector having a surface disposed to intercept a portion of the antenna pattern and an edge disposed in the null region.

2. A radio frequency antenna comprising:

(a) feed means for producing a difference pattern having a cone-shaped null; and, (b) a reflector having a surface disposed to intercept a portion of the difference pattern and an edge disposed on the cone-shaped null.

3. The antenna recited in claim 2 wherein the surface of the reflector is disposed to intercept the energy in a first one of the pair of difference lobes of the radiation pattern while allowing the energy in the second one of the pair of lobes to radiate into free space.

4. The antenna recited in claim 3 wherein the reflector is disposed to reflect the portion of the energy in the first one of the lobes and direct such reflected energy in substantially the same direction as the energy in the second one of the pair of lobes to combine the reflected energy and the energy in the second one of the lobes into a composite beam.

* * * * *